US009370857B2

(12) United States Patent
Guenther et al.

(10) Patent No.: US 9,370,857 B2
(45) Date of Patent: Jun. 21, 2016

(54) PIPE WRENCH OR WATER PUMP WRENCH

(75) Inventors: Norbert Guenther, Hueckeswagen (DE); Marco Theissen, Odenthal (DE); Stefan Schultes, Solingen (DE)

(73) Assignee: ROTHENBERGER AG, Kelkheim (DE)

( * ) Notice: Subject to any disclaimer, the term of this patent is extended or adjusted under 35 U.S.C. 154(b) by 259 days.

(21) Appl. No.: 14/125,985

(22) PCT Filed: Jun. 18, 2012

(86) PCT No.: PCT/DE2012/100180

§ 371 (c)(1),
(2), (4) Date: Dec. 13, 2013

(87) PCT Pub. No.: WO2012/175076

PCT Pub. Date: Dec. 27, 2012

(65) Prior Publication Data

US 2014/0116208 A1 May 1, 2014

(30) Foreign Application Priority Data

Jun. 20, 2011 (DE) ..... 20 2011 050 505 U

(51) Int. Cl.
*B25B 7/10* (2006.01)
*B25B 7/00* (2006.01)

(52) U.S. Cl.
CPC .... *B25B 7/10* (2013.01); *B25B 7/00* (2013.01)

(58) Field of Classification Search
CPC ..... B25B 7/10; B25B 7/00
USPC ..... 81/411–413, 416
See application file for complete search history.

(56) References Cited

U.S. PATENT DOCUMENTS

| | | | | |
|---|---|---|---|---|
| 1,401,931 | A | 12/1921 | Whelan | |
| 2,409,627 | A | 10/1946 | Helgeson | |
| 6,199,459 | B1 | 3/2001 | Azkona | |
| 6,679,140 | B1 | 1/2004 | Flavigny | |
| 6,694,848 | B1 * | 2/2004 | Flavigny | B25B 7/10 81/357 |
| 7,406,898 | B1 * | 8/2008 | Hall, Jr. | B25B 7/10 81/358 |
| 8,661,948 | B2 * | 3/2014 | DeBaker | B21K 5/00 81/405 |
| 8,695,464 | B2 * | 4/2014 | Herrmann | B25B 7/10 81/409 |
| 2004/0221694 | A1 * | 11/2004 | Kuo | B25B 7/10 81/413 |
| 2010/0282032 | A1 * | 11/2010 | Brailey | B25B 7/14 81/385 |

FOREIGN PATENT DOCUMENTS

| | | | |
|---|---|---|---|
| DE | 1600060 | U | 2/1950 |
| DE | 20020980 | U1 | 4/2001 |
| DE | 69929952 | T2 | 9/2006 |
| DE | 102006010234 | A1 | 9/2007 |
| FR | 2798875 | A1 | 3/2001 |

* cited by examiner

*Primary Examiner* — David B Thomas
(74) *Attorney, Agent, or Firm* — Leydig, Voit & Mayer, Ltd.

(57) ABSTRACT

A pipe wrench or water pump wrench includes a clamp having a first shaft-like grip part and a handle having a second shaft-like grip part. A first jaw having a first gripping surface is disposed at one end of the clamp and a second jaw having a second gripping surface is disposed at one end of the handle. The second gripping surface is formed so as to be complementary to the first gripping surface. The jaws extend in a jaw gripping direction. The gripping surfaces form a first gripping recess. An adjusting mechanism having a toothed slot is disposed in the clamp. The toothed slot is curved in the jaw gripping direction. A pivot pin connects the clamp and the handle in a pivotable manner with respect to one another. The pivot pin is displaceable via the adjusting mechanism.

7 Claims, 3 Drawing Sheets

PIPE WRENCH OR WATER PUMP WRENCH

CROSS-REFERENCE TO PRIOR APPLICATIONS

This application is a U.S. National Phase application under 35 U.S.C. §371 of International Application No. PCT/DE2012/100180, filed on Jun. 18, 2012, and claims benefit to German Patent Application No. DE 20 2011 050 505.7, filed on Jun. 20, 2011. The International Application was published in German on Dec. 27, 2012 as WO 2012/175076 under PCT Article 21(2).

FIELD

The invention relates to a pipe wrench or water pump wrench containing a) a clamp having a first shaft-like grip part, at one end of which a first jaw having a gripping surface is provided,
b) a handle having a second shaft-like grip part, at one end of which there is arranged a second jaw which is formed with an appropriately complementary gripping surface with respect to the first jaw,
c) a pivot pin around which the clamp and the handle are formed so as to be pivotable with respect to one another, the pivot pin being formed in a displaceable manner by means of an adjusting mechanism,
d) the adjusting mechanism having a toothed slot in the clamp, in which toothed slot a likewise toothed latching body engages in a first position for latching, the latching body being formed so as to be displaceable in a second position in the toothed slot.

BACKGROUND

A pipe wrench is the conventional tool for plumbing installations and heating and ventilation engineering and is used when working on pipes and the fastening elements used when fitting pipes (sockets, union nuts, etc.). The pipe wrench is self-clamping as a result of its lever mechanism, a knurled nut on the lower lever arm adjusting the opening width of the pipe wrench such that the handle and the clamp no longer need to be pressed together in order to grip the workpiece firmly. The clamp is moved to rotate the workpiece. The wrench has to be turned round to rotate in the other direction and the position of the gripping teeth is only designed to operate in one direction.

Pipe wrenches differ in the way they operate. Pipe wrenches are distinguished according to the orientation of their opening area (90° or 45°) and the shape of their jaws (straight for gripping objects with parallel surfaces, such as nuts, straight and curved for gripping objects with parallel surfaces or round objects and s-shaped for gripping round objects).

The pipe wrench with continuous rapid adjustment is a further modification. In this case the opening width is not varied by means of the knurled nut, but by simply moving the wrench arm in the opened position and by engaging said arm on a toothed rack in the closed position.

German Patent DE 699 29 952 T2 discloses a pipe wrench consisting of two wrench bodies. The wrench bodies have clamping jaws which rotate one below the other around a rotary shaft and can be displaced with respect to one another on a recess provided on one of the wrench bodies. The rotary shaft contains a latch which represents a unilateral multiple toothed arrangement and an actuating arm to unlock the teeth if the user so desires. The latch comprises a spring which locks the teeth until the actuating arm is moved by the spring impacting with the arm on which a groove is provided.

DE 10 2006 010 234 A1 describes a pipe wrench with a protected forced guidance system. The pipe wrench consists of a first and a second wrench arm. The first wrench arm has a longitudinal slot. The second wrench arm and a guide pin formed on a second jaw are guided through this longitudinal slot. The first wrench arm also has a latching body which is formed by the slot which is parallel to the forced guidance system and by at least one latching tooth provided on the trunnion. The forced guidance system is located on the movable jaw and is formed by two opposite, plane support surfaces parallel to the wrench pivot pin and located at the side of the first wrench arm.

U.S. Pat. No. 1,401,931 discloses a pipe wrench in which the handle and the clamp can be displaced with respect to one another in a guide means. The jaws are at one end of the handle or clamp and the grip shaft is at the other end. By actuating the wrench, the jaws are moved together to grip or apart to release. The guide means consists of an element with a slot. The joint pins around which the handle and the clamp can be moved are provided such that they can each be displaced in the slot. Thus the width of the jaws can also be adjusted for rough adjustment purposes in addition to pivoting around the joint pins in each case. The guide means which is formed by the slot is curved in the direction of the jaws in this case. As a result the jaws achieve an optimum position with respect to one another. The element itself with its outer surface forms part of the gripping surface and is correspondingly toothed like the gripping surfaces of the jaws.

A pipe wrench having a handle with a first shaft-like grip part, at one end of which a first jaw is provided, is known under the registered trade name of COBRA XL/XXL pipe and water pump wrenches, item No. 8701400, from Knipex-Werke C. Gustav Putsch KG in Wuppertal. The pipe wrench also has a clamp with a second shaft-like grip part, at one end of which there is arranged a second jaw which is formed with an appropriately complementary gripping surface with respect to the first jaw. In this pipe wrench the handle and the clamp are formed such that they can pivot with respect to one another around a pivot pin. The pivot pin is in this case formed in a displaceable manner by an adjusting mechanism in a slot on the handle. The slot is curved in an opposite direction to the gripping direction.

German utility model DE 200 20 980 U1 discloses a water pump wrench in which the gripping surfaces of the jaws form a diamond-shaped opening. The joint pin, around which the handle of the water pump wrench is designed to pivot, is provided such that it can be displaced in a slot on the clamp of the wrench to allow rough adjustment of the jaws.

German utility model 1600060 discloses a water pump wrench in which the gripping surfaces of the jaws form two diamond-shaped gripping openings. The joint pin of the clamp is arranged in a toothed slot on the handle such that it can be displaced and adjusted.

SUMMARY

In an embodiment, the present invention provides a pipe wrench or water pump wrench including a clamp having a first shaft-like grip part and a handle having a second shaft-like grip part. A first jaw having a first gripping surface is disposed at one end of the clamp and a second jaw having a second gripping surface is disposed at one end of the handle. The second gripping surface is formed so as to be complementary to the first gripping surface. The jaws extend in a jaw gripping direction. The gripping surfaces form a first gripping recess. An adjusting mechanism having a toothed slot is disposed in the clamp. The toothed slot is curved in the jaw gripping direction. A pivot pin connects the clamp and the handle in a pivotable manner with respect to one another. The pivot pin is displaceable via the adjusting mechanism, wherein a toothed latching engages, in a first position, with the toothed slot and is displaceable, in a second position, along the toothed slot.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
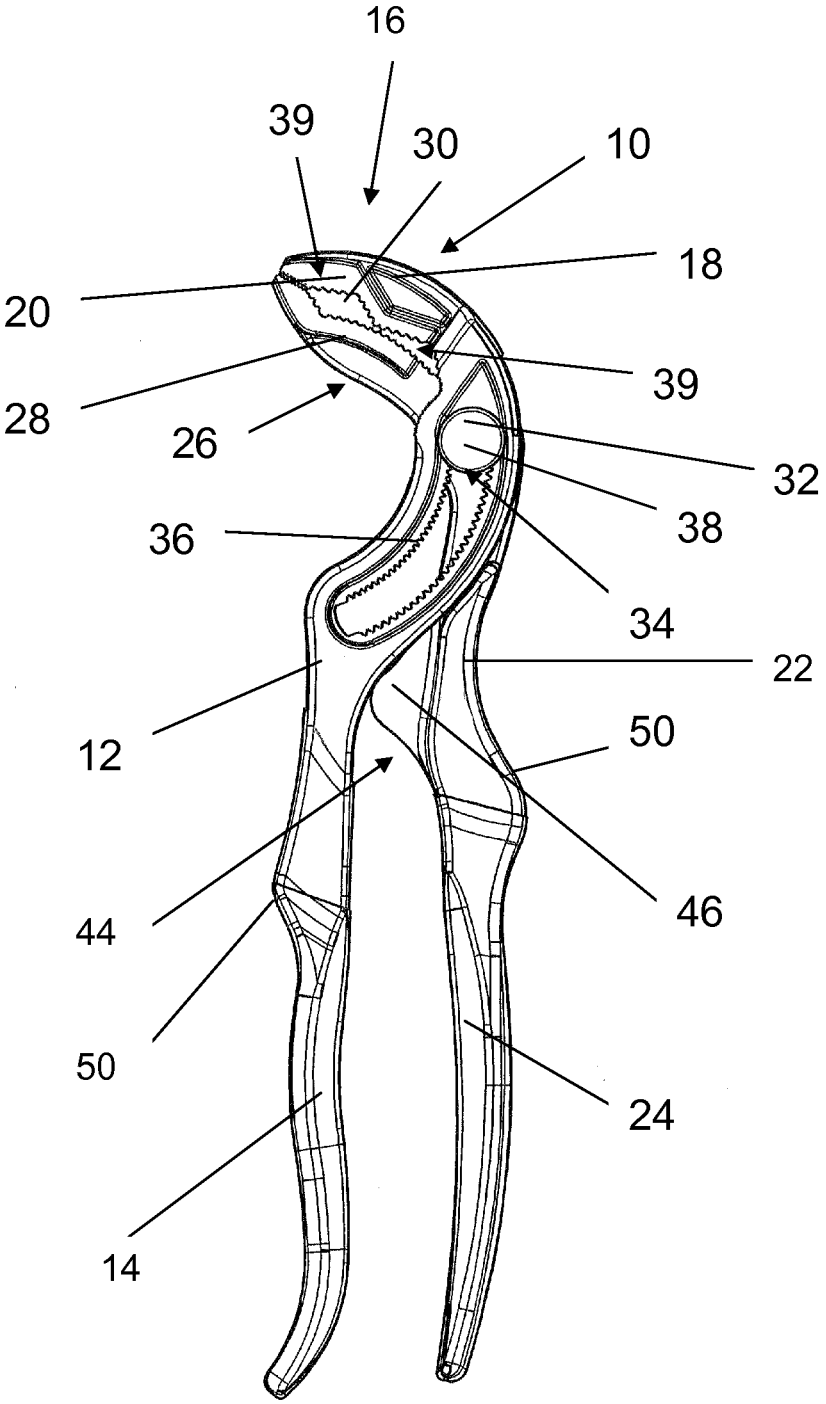
FIG. 1 shows a pipe wrench according to the invention from a first side.

The present invention recognizes some disadvantages of the prior art described above are that the pipe wrench or water pump wrench is either relatively complicated, consists of many components, does not offer pinch protection for the user or is not designed to be robust. The fact that the jaws do not grip the object to be gripped in an optimum manner in every position is also disadvantageous.

In an embodiment, the present invention avoids the disadvantages of the prior art and provides a pipe wrench or water pump wrench which is robust and offers maximum possible pinch protection with a large and as variable as possible an opening width. The pipe wrench or water pump wrench should in this case be able to grip a workpiece safely and in an optimum manner in each wrench position.

In an embodiment, the invention provides a pipe wrench or water pump wrench of the type mentioned at the outset in which f) the slot is curved in the jaw gripping direction and g) the gripping surfaces of the jaws form a diamond-shaped gripping opening.

An embodiment of the invention is based on the principle that the gripping surface is always positioned in an optimum manner with respect to the workpiece. By means of the diamond-shaped gripping opening, the gripping jaws come into contact with the workpiece equally on a number of sides. The fact that the slot is curved in the gripping direction means that the gripping surfaces are positioned in an almost optimum manner with respect to one another for gripping the workpiece even during rough adjustment. As a result the wrench grips the workpiece over a correspondingly large area. This means maximum friction, with the result that the workpiece does not slip and is evenly loaded for gripping. In addition, the opening of the pipe wrench or water pump wrench according to an embodiment of the invention offers considerable scope for gripping in the opened state. As a result the wrench can be positioned better on the workpiece to be gripped.

Providing two spaced gripping recesses on the respective gripping surfaces of the jaws represents an advantageous embodiment of the invention. This measure serves to ensure that the jaws achieve an optimum position with respect to the workpiece and the gripping surfaces of the jaws surround the workpiece over as large an area as possible in each of the positions.

A further preferred configuration of the pipe wrench or water pump wrench according to an embodiment of the invention is achieved by the two gripping openings being different sizes. The pipe wrench or water pump wrench can thus grip workpieces of different dimensions better.

In a preferred configuration of the pipe wrench or water pump wrench according to an embodiment of the invention, the gripping recesses form a diamond-shaped gripping opening when the jaws are in the closed state. The diamond-shaped gripping opening can be manufactured easily and surrounds almost all workpieces in an optimum manner.

A preferred configuration of the pipe wrench or water pump wrench according to an embodiment of the invention is obtained by providing a pinch protection means which is formed by a recess and/or a curve on the clamp and a complementary projection on the handle. This pinch protection means prevents a user from trapping their fingers between the handle and the clamp when gripping in all latching positions.

This pinch protection means for the pipe wrench or water pump wrench according to an embodiment of the invention is preferably only formed on one side. In this case the recess and the complementary projection of the pinch protection means are only provided on half the handle or clamp respectively. This not only ensures additional stability, but also in some cases prevents fingers getting stuck in the pinch protection means itself.

A further preferred variation of an embodiment of the invention entails the clamp and/or the handle comprising a protrusion as a slip protection means. A protrusion of this kind prevents users slipping from the grip and is a feature which accounts for the increased safety of such a tool.

A pipe wrench 10 according to an embodiment of the invention is shown from a first side in FIG. 1. The pipe wrench 10 has a clamp 12 with a first shaft-like grip part 14, at one end 16 of which a first jaw 18 with a gripping surface 20 is provided. The clamp 12 interacts with a handle 22. The handle 22 has a second shaft-like grip part 24, at one end 26 of which a second jaw 28 is arranged. The second jaw 28 comprises a gripping surface 30, which is formed to be appropriately complementary with respect to the gripping surface 20 of the first jaw 18.

The clamp 12 and the handle 22 are formed so as to be pivotable with respect to one another around a pivot pin 32. The pivot pin 32 can be displaced by means of an adjusting mechanism 34 in this case. The adjusting mechanism 34 comprises a toothed slot 36 in the clamp 12. The slot 36 is curved in the direction of the jaws 18, 28. The fact that the slot 36 is curved means that the jaws 18, 28 are guided in an optimum manner with respect to each other so that they can grip a workpiece firmly irrespective of the width of the parted jaws 18, 28. The pivot pin 32 can be displaced in the slot 36 for rough adjustment purposes (also see FIG. 2). The pivot pin 32 sits in a toothed latching body 38. The width of the latching body 38 teeth corresponds to that of the slot 36, with the result that the teeth are always able to engage with each other. The latching body 38 engages in a first position for latching purposes. In a second position the toothed latching body 38 is formed such that it can be displaced in the toothed slot 36 (also see FIG. 2). The latching body 38 can be displaced axially for this purpose: once into a latching position and once out of the latching position. The latching body 38 is also formed such that it enables the clamp 12 and the handle 22 to pivot with respect to one another. This is achieved by a suitable joint, for example. In this case a peg or a pin is provided on the handle 22 which is pivotally mounted in a sleeve. The sleeve forms part of the toothed latching body 38.

The gripping surfaces 20, 30 form two diamond-shaped recesses 39. These diamond-shaped recesses serve to surround a workpiece 42 (see FIG. 2) with a larger area when gripping. As a result the workpiece 42 is loaded more evenly during gripping. The workpiece 42 can thus be gripped more firmly overall because the forces applied are distributed more evenly. Owing to the two diamond-shaped recesses 39 being different sizes, different sizes of workpieces 42 can be gripped better. Either one or the other diamond-shaped recess 39 is used as required.

A pinch protection means is denoted by 44. The pinch protection means 44 consists of a projection 46 which is arranged on the handle 22 and a correspondingly complementary recess or curve 48 in the clamp 12. This serves as a stop mechanism when the pipe wrench 10 is activated. In the present embodiment, both the projection 46 and the complementary recess 48 (see FIG. 3) are designed on only one side. This has a stabilising effect in the grip design. However, it is also conceivable that such a pinch protection means 44 might not only be formed on one side. A further safety aspect in addition to the pinch protection means 44 consists of a protrusion 50 formed as a slip protection means, said protrusion being arranged on the handle 22 or on its grip part 24. The protrusion 50 helps to prevent a user's hand from slipping off the grip part 24, as the protrusion 50 limits the gripping area for the hand.

Figure 2:
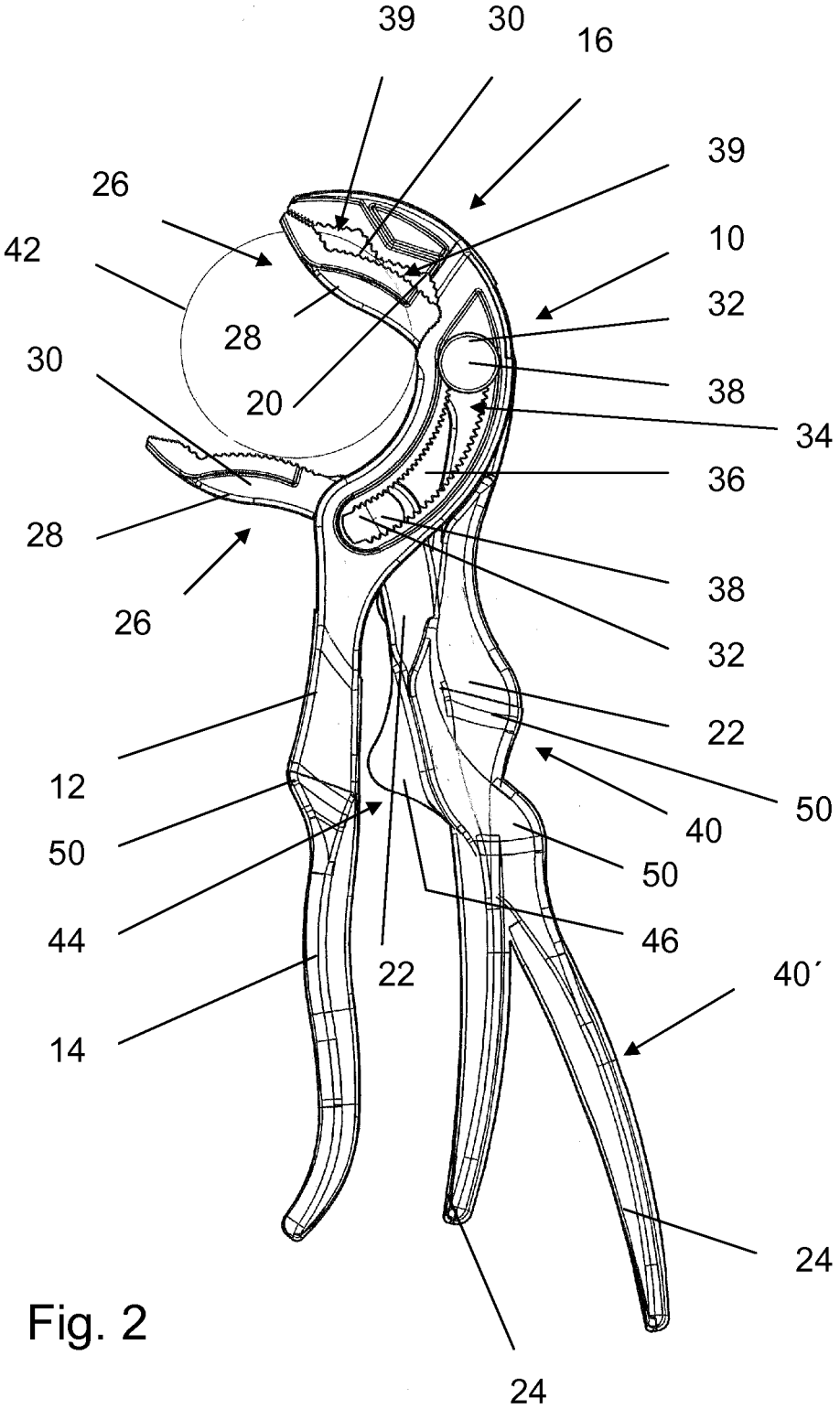
FIG. 2 shows a pipe wrench according to the invention in use.

FIG. 2 shows the use of a pipe wrench 10 according to the invention. If the components of the pipe wrench correspond to FIG. 1, the same reference numerals are used. The handle 22 is shown in two positions 40, 40'. The first position is the position 40, in which the jaws 18, 28 are closed. In this position the pivot pin 32 is in the upper part of the slot 36.

The pipe-shaped workpiece 42 is gripped in the second position 40'. For this purpose, the pivot pin 32 needs to be displaced in the bottom part of the slot 36 for rough adjustment purposes. The handle 22 is in this case in a suitable pivoting position around the pivot pin 32. This allows the workpiece 42 to be gripped.

As shown in FIG. 2, the jaws 18, 28 can always be positioned in an optimum manner with respect to one another owing to the curve of the slot 36. The workpiece 42 can thus be gripped in an optimum manner in the proposed solution.

Figure 3:
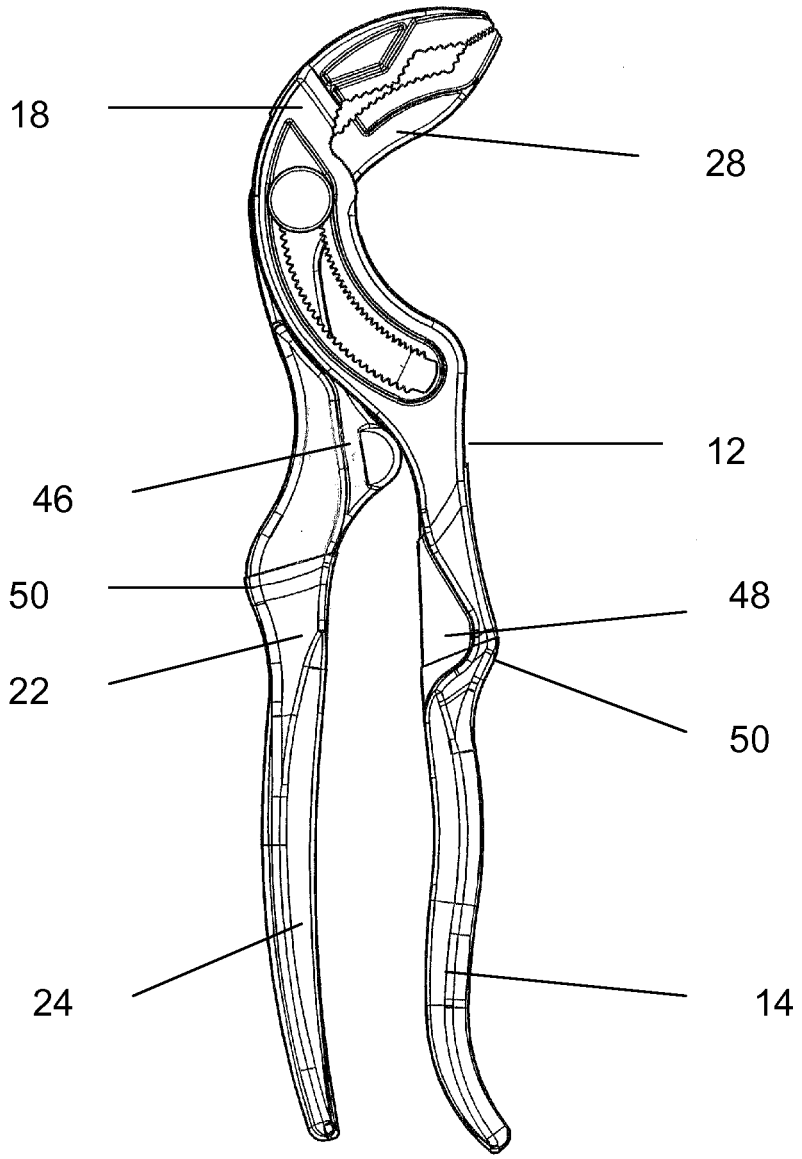
FIG. 3 shows a pipe wrench according to the invention from a second side.

FIG. 3 shows the pipe wrench 10 from a second side. The reference numerals correspond to the previous drawings in this respect. This figure is intended essentially to show the pinch protection means 44 on one side, said pinch protection means not being immediately visible from the illustrations in FIGS. 1 and 2. The pinch protection means 44 consists of the projection 46 which is arranged on the handle 22 and the correspondingly complementary recess or curve 48 in the clamp 12. This serves as a stop mechanism when the pipe wrench 10 is actuated. In this case both the projection 46 and the complementary recess 48 are only formed on one side. This has a stabilising effect on the grip design. In each latching position of the latching body 38 in the slot 36, this prevents a user getting their fingers trapped between the clamp 12 and the handle 22 when actuating the pipe wrench.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A pipe wrench or water pump wrench, comprising:

a clamp having a first shaft-like grip part, a first jaw having a first gripping surface being disposed at one end of the clamp;

a handle having a second shaft-like grip part, a second jaw having a second gripping surface being disposed at one end of the handle, the second gripping surface being formed so as to be complementary to the first gripping surface a first gripping recess being formed between the first and second gripping surface;

an adjusting mechanism having a toothed slot disposed in the clamp, the toothed slot being curved such that a concave side of the slot faces the first gripping recess;

a pivot pin connecting the clamp and the handle in a pivotable manner with respect to one another, the pivot pin being displaceable via the adjusting mechanism, wherein a toothed latching engages, in a first position, with the toothed slot and is displaceable, in a second position, along the toothed slot.

2. The pipe wrench or water pump wrench according to claim 1, wherein the gripping surfaces further form a second gripping recess spaced from the first gripping recess.

3. The pipe wrench or water pump wrench according to claim 2, wherein the two gripping recesses are different sizes.

4. The pipe wrench or water pump wrench according to claim 2, wherein the gripping recesses form a diamond-shaped gripping opening when the jaws are in the closed state.

5. The pipe wrench or water pump wrench according to claim 1, further comprising a pinch protection means formed by a recess or curve on the clamp and a complementary projection on the handle.

6. The pipe wrench or water pump wrench according to claim 5, wherein the recess or curve is provided on only one side of the clamp and the complementary projection is provided on only one side of the handle.

7. The pipe wrench or water pump wrench according to claim 1, wherein at least one of the clamp and the handle include a protrusion configured as a slip protection means.

* * * * *